United States Patent [19]

Rakowski

[11] 4,169,600

[45] Oct. 2, 1979

[54] FOOTBALL SIMULATION GAME WHEREIN STANDARD PLAYING CARDS ARE USED

[76] Inventor: Julius B. Rakowski, 6933 Glenheights Rd., Baltimore, Md. 21215

[21] Appl. No.: 852,095

[22] Filed: Nov. 16, 1977

[51] Int. Cl.[2] ..... A63F 3/00

[52] U.S. Cl. ..... 273/247

[58] Field of Search ..... 273/94 R, 247, 259, 273/285, 287

[56] References Cited

U.S. PATENT DOCUMENTS

| | | | |
|---|---|---|---|
| 1,675,619 | 7/1928 | Sorlien | 273/94 R |
| 2,946,134 | 0/1960 | Neilson | 273/94 R |
| 3,123,360 | 0/1964 | Peckham | 273/94 R |
| 3,833,220 | 9/1974 | Schurdell | 273/247 |
| 3,973,773 | 8/1976 | Glass | 273/94 R |

*Primary Examiner*—Richard C. Pinkham
*Assistant Examiner*—R. Carl Moy
*Attorney, Agent, or Firm*—Walter G. Finch

[57] ABSTRACT

A table game of football, which is played upon a game board, upon which there is imprinted different positions for football players, together with movements in a play, the game additionally including an instruction sheet, a score keeper, a plurality of playing pieces, and a deck of cards.

8 Claims, 3 Drawing Figures

Fig.1
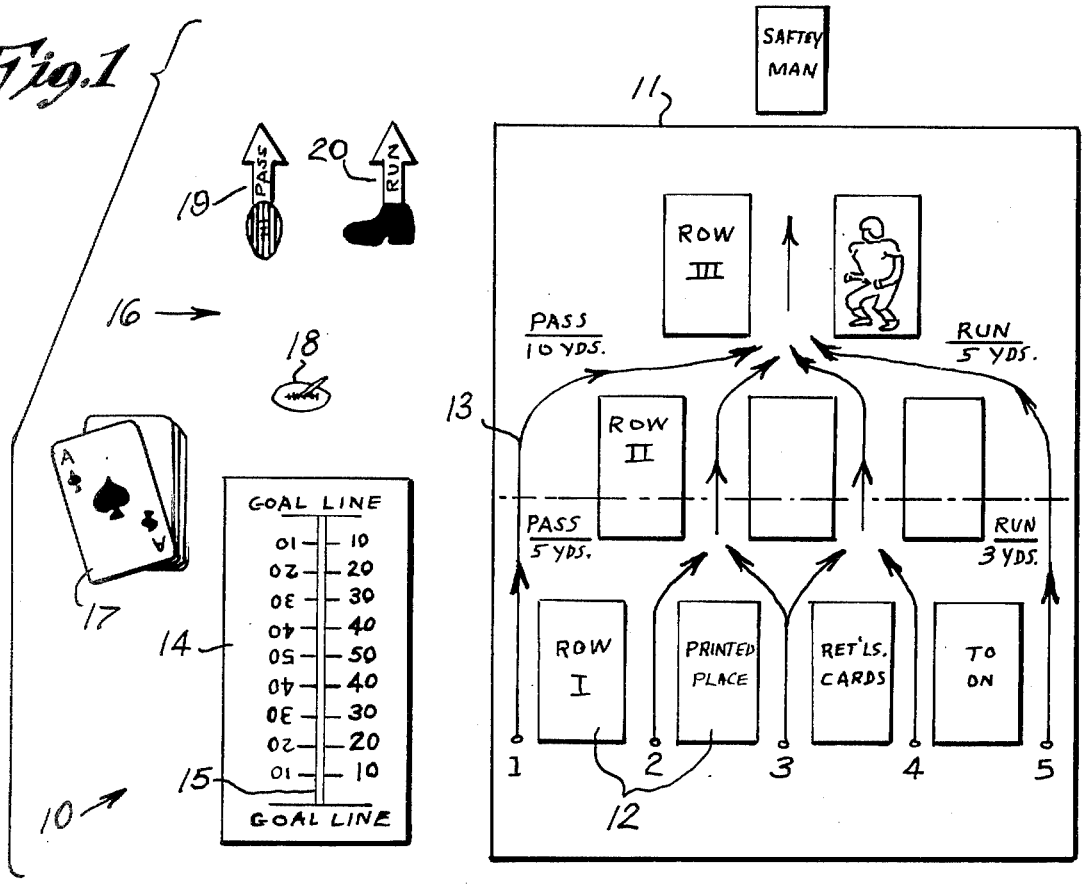
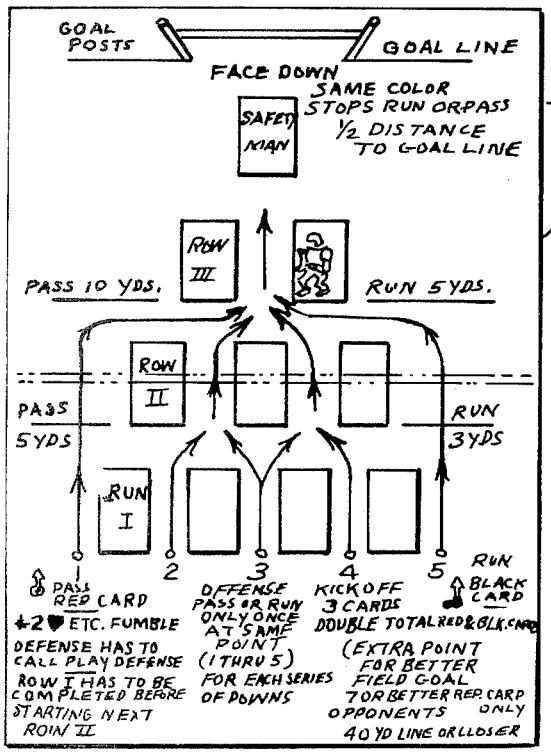
Fig.2
Fig.3
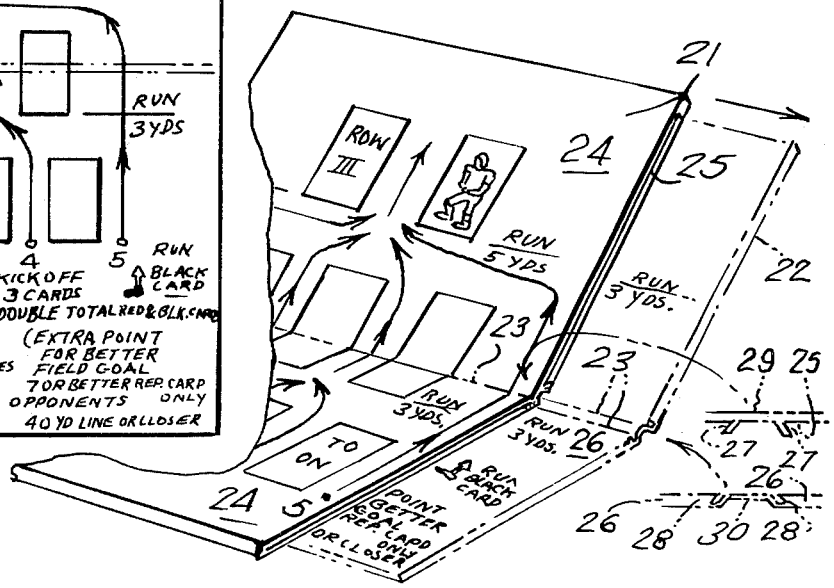

FOOTBALL SIMULATION GAME WHEREIN STANDARD PLAYING CARDS ARE USED

This invention relates generally to table-top board games.

A principal object of the present invention is to provide a football simulation game, which can be played upon a game board, and which includes every conceivable football play, which can be symbolized in the present game, in order to provide realism, interest and excitement to participating players.

Another object is to provide a game, which can be played either as a solitaire game, or else by two players playing competitively.

Still another object is to provide a game, which can be played by all persons, as well as children from approximately 10 years of age.

Other objects are to provide a game, which is simple in design, inexpensive to manufacture, rugged in construction, easy to use and efficient in operation.

These, and other objects, will be readily evident, upon a study of the following specification, and the accompanying drawing, wherein:

FIG. 1 is a plan view, showing the various components used in playing the game;

FIG. 2 is a face view of an instruction sheet of the game; and

FIG. 3 is a fragmentary perspective view of a modified design of the invention, in which the game board stores the instruction sheet against a rear side thereof, so as to be always handy for use.

Referring now to the drawing in greater detail, the reference numeral 10 represents a game, according to the present invention, wherein there is a game board 11, upon which there is imprinted a diagram 12, showing positions of football players in a play of the game. Additionally, there is imprinted, by means of arrows 13, the various movements in the playing of a game.

The game additionally includes a score keeper 14, that includes a metal or wire strip 15. This score keeper measures six by twelve inches, while the game board 11 measures approximately fifteen by twenty-four inches.

The game additionally includes playing pieces 16 and a deck of cards 17. Additionally, as shown in FIG. 2, an instruction sheet 18, imprinted with a same diagram and movements of the game board, additionally includes instructions for advising players in the movements of a game.

In playing the game, the playing cards are shuffled and cut, so the high cards have the choice of offence or defence. The defence team then places the ball playing piece 19 upon the forty yard line. For the kick-off, the top three cards are laid on the table. The points are doubled for kicking yardage. Face cards and aces count for ten points.

For example, ace, 7 and 4 cards are used for a total of twenty-one points, and which, multiplied by two, equal forty-two yards as the yardage. The yardage on the score keeper 14 is graduated in units of ten yards. Two yards are dropped, and five or more points are added to form whole numbers in units of ten.

Therefore, the football for forty yards would be placed on the opponent's twenty yard line. The offensive unit takes over from there. A designated card, such as the 2 of hearts is used for fumbles. No jokers are used. If the 2 of hearts shows up in any of the three cards on the table, the kicking team is penalized ten yards, moving the ball back to the thirty yard line, and resuming the same procedure from there. For three cards and their doubling total, whenever the 2 of hearts, or any other designated fumble card shows up with the offensive play, the defensive team audibly says "fumble", and takes over at this point of play. The responsibility for calling the fumble rests on the defense, and has to be called before the play of the following card, or else the fumble is recovered by the offense team.

After the kick-off, the defense player takes the cards, and re-shuffles the entire deck. He now takes the first four cards off the top, and places them on the rectangles of the printed playing field 12, on the game board 11. The defense player may place each of the four cards on any rectangle of the row One that he may choose for defense purposes so that one card is on each rectangle. This has to be completed before taking the next three cards, and placing them on row number Two. Again, he has the option of transferring those three cards, in any fashion, upon this row number Two. The next two cards are then taken and placed on row number Three in a manner similar to the placing of cards on rows One and Two.

As for the last card, the safety man is placed face down. Thus, all the cards for the defense are accounted for. The remainder of the deck of cards, without any further shuffling, is handed over to the offensive player. The playing pieces 19 and 20 are now considered. These measure approximately one and one-half inch by four inches long. Playing piece 19 represents an offensive player desire to pass, while playing piece 20 is used for the running game, and, upon occasion, for kicking.

As an illustration, the player decides to place playing piece 19, representing passing, at a junction 3 marked row number One upon the game board 11. When passing, using playing piece 19, the card must be red to begin with, or a down is automatically lost. When the offense tries a running play, the card must be black to begin with, or one loses a down. If otherwise, the play begins at penetration point.

To penetrate in row 1, and succeeding rows, the color of the card must be in accordance with the intended play, red for passing and black for running. It also must be a higher rank than the one or two cards it faces, at that particular point, in order to proceed to another row.

On points one through five, it is permissable to run two plays, at each point, but no repetition. There must be one pass and one running play, never two of the same kind, as two passes or two runs will be illegal procedure, and a lost down. The offense does not have to run the play at any one point simultaneously, they have the option of running a play through point two. Later in the sequence of downs one can come back at point two, and use a passing play, (legal). After using two plays at the same point (running and passing), that point of entrance is closed to him for that sequence of downs, and also, any time during the sequence of downs by the offensive team, they have the option of kicking, the same as kick-off, using piece 20, while audibly informing the opponent of intentions. In case of a tie in this time element, game periods of five minutes for overtime may be used, or sudden death for the breaking points. The exact points and time remain flexible, and can be changed by the players.

It shall also be noted, that in order to obtain a field goal, one must be as close as the opponent's forty yard line, or closer. The offensive player will audibly disclose his intents, saying he is trying for a field goal by using piece 20. The next card on top of the deck must be a red card evaluation of seven or better to score, otherwise, lower than seven, or a black card, offense loses the ball at the spot of play.

In the aforegoing example of play procedure, the relative strength of the playing cards determines the offensive or defensive results. For example, if in a play the offense turns up a queen, then the queen can advance along the directional line of movement of the position selected for the play, as long as the defensive player card met along the way on either side of the directional line is of a lesser rank (jack or lower). A queen or higher in the defensive player locations along the directional line will stop the advance at that point. Note on the game board that positions 1, 2, 4, and 5 have a specific route to follow for the play, whereas position 3 has an option to left or right after passing through row One. All directional lines of movement pass between the two defensive player positions in row Three.

The above described example of playing the game indicates only one particular example, and complete instructions would be incorporated into an instruction book, provided with the, so that all players are completely knowledgeable for playing the game.

Referring now to FIG. 3 of the drawing, there is shown a modified design of game board 20, which, upon its rear side, serves to store the instruction sheet 22. The game board and instruction sheet are the same as described above, except that they are made to fold over across a center, as indicated at 23, so that they may be stored within a minimum storage space. In order to accomplish the storage of the instruction sheet around a fold across a center thereof, each panel 24 of the board includes a recess 25, for slideably receiving a panel 26, that form opposite ends of the instruction sheet 22. The opposite end edges 27, of each groove 25, is angularly inclined, so as to slideably retain the panel 26, which is, accordingly, correspondingly shaped along opposite side edges 28. The panels 24 are connected together by a flexible ridge 29, across which the fold 23 exists, and the panels 26 are connected by a ridge 30, which likewise flexes, so as to form the folds 23. Thus, either in a folded position, or a flat position of the game board, the instruction sheet cannot accidentally fall out.

While various changes may be made in the detail construction, it is understood that such changes will be within the spirit and scope of the present invention, as is defined by the appended claims.

What I now claim is:

1. A football simulation game, comprising:

a game board having a series of rectangles imprinted thereon comprising a first row having a plurality of rectangles therein, a second row having a plurality of rectangles therein, and a series of directional lines imprinted on said board between said rectangles, at least one of said lines extending from adjacent a rectangle in said first row and branching in directions to both sides of a rectangle in said second row, and least one other of said lines extending from adjacent a rectangle in said first row in a direction generally toward a rectangle of said second row, said lines representing simulated defensive football player positions;

a score keeper device to indicate the location of the simulated football from play to play during the game as played on said game board;

a deck of playing cards for use as simulated defensive players on said game board, for determining simulated kick distances during play, for determining strength of simulated offensive player versus simulated defensive players on said game board, and for differentiating between a simulated pass and a simulated run;

a playing piece to represent a pass play; and a playing piece to represent a running play.

2. The football simulation game as recited in claim 1, wherein said simulated defensive football player positions consist of rectangles within which selected playing cards are placed representing simulated defensive football players, said rectangles being arranged in four rows, the first said row facing the opposition consisting of four spaced rectangles, the second said row consisting of three rectangles, the third said row consisting of two rectangles, and a fourth said row, consisting of one rectangle.

3. The football simulation game as recited in claim 1, wherein said directional lines representing simulated offensive football play movements are in five positions, a first position beginning to the left of the first row and passing to the left of the second row and then passing between the two rectangles in the third row, a second position beginning between the first and second rectangles in the first row and then passing between left and middle rectangles in the second row and then passing between the two rectangles in the third row, a third position beginning at the center between the two center-most rectangles in the first row and then having optional pathways to left and right to pass between the center rectangle and the adjacent rectangle in the second row and then passing between the two rectangles in the third row, a fourth position beginning between the two right hand most rectangles in the first row and being a mirror image of the second position, and a fifth position beginning to the right of the first row and being a mirror image of the first position, said directional lines having arrow heads thereon to indicate direction of simulated movements.

4. The football simulation game as recited in claim 1, wherein said scorekeeper device consists of rectangular flat base having a metal strip along the longitudinal centerline thereof, having spaced transverse lins marked on said base to simulate the ten yard lines of a football field and the goal lines at each end thereof and so identified on said base, and having a miniature simulated football piece to move along said metal strip to designate the location of the simulated football as the simulated football game is played.

5. The football simulation game as recited in claim 1, wherein said deck of playing cards is a standard bridge deck of playing cards.

6. The football simulation game as recited in claim 1, wherein said playing piece to represent a pass play is a flat simulated miniature football having an arrow attached on which is imprinted the word "PASS".

7. The football simulation game as recited in claim 1, wherein said playing piece to represent a running play is a flat simulated miniature shoe having an arrow attached on which is imprinted the word "RUN".

8. The football simulation game as recited in claim 1, wherein said game board is foldable about a transverse central fold line and being formed with a recess on the back thereof, for receiving an instruction sheet which is foldable about a transverse central fold line and slidably inserted within said recess for storage.

* * * * *